United States Patent [19]

Bommaraju et al.

[11] 3,969,217

[45] July 13, 1976

[54] ELECTROLYTIC ANODE

[75] Inventors: Tilak V. Bommaraju; Donald E. Stephens, both of Grand Island, N.Y.

[73] Assignee: Hooker Chemicals & Plastics Corporation, Niagara Falls, N.Y.

[22] Filed: Oct. 7, 1974

[21] Appl. No.: 513,009

[52] U.S. Cl. ..... 204/290 F; 204/290 R

[51] Int. Cl.[2] ..... C25B 11/06; C25B 1/34; C25B 10/10

[58] Field of Search ..... 204/290 F, 290 R

[56] References Cited

UNITED STATES PATENTS

| | | | |
|---|---|---|---|
| 3,491,014 | 1/1970 | Bianchi et al. | 204/242 |
| 3,554,811 | 1/1971 | Isenberg et al. | 136/120 FC |
| 3,706,644 | 12/1972 | Martinsons | 204/98 |
| 3,711,382 | 1/1973 | Anthony | 204/1 R |
| 3,711,397 | 1/1973 | Martinsons | 204/290 F |

OTHER PUBLICATIONS

Anodic Films by Young, pp. 319, 320, pub. by Academic Press, New York, 1961.

*Primary Examiner*—F.C. Edmundson
*Attorney, Agent, or Firm*—Peter F. Casella

[57] ABSTRACT

An improved electrode, useful as an anode for the electrolysis of brines comprises an electrically conductive substrate having adhered thereto and extending over at least a portion of the surface thereof, a coating of mixed oxides comprising about 10 to about 80 mole percent indium oxide and about 10 to about 90 mole percent of a platinum group metal oxide. Up to about 20 mole percent of tin oxide may be incorporated in the coating to lower the electrical resistivity thereof.

11 Claims, No Drawings

ELECTROLYTIC ANODE

BACKGROUND OF THE INVENTION

The present invention relates to improved electrodes, particularly adapted for use as anodes in electrochemical processes involving the electrolysis of brines. A variety of materials have been tested and used as anode materials in electrolytic cells. In the past, the material most commonly used for this purpose has been graphite. However, the chlorine overvoltage of graphite is relatively high in comparison, for example, with the noble metals. In addition, in the corrosive media of an electrochemical cell graphite wears readily, resulting in substantial loss of graphite and the ultimate expense of replacement as well as continued maintenance problems resulting from the need for frequent adjustment of spacing between the anode and the cathode as the graphite wears away. As a result, in recent years considerable effort has been expended in attempts to develop improved anode materials and structures. In particular, anodes have been developed which comprise a platinum group metal or oxide thereof, coated on the surface of a valve metal substrate such as titanium. The chlorine overvoltage and dimensional stability of the platinum metals, in corrosive media, represents a substantial improvement over graphite. However, the high cost of platinum group metals or oxides, even when used as a coating, presents an economic disadvantage.

Accordingly, it is an object of the present invention to provide improved electrodes for use as anodes in electrochemical processes involving the electrolysis of brines. It is a further object to provide such anodes which exhibit the desirably low chlorine overvoltage and dimensional stability commonly associated with the noble metals and noble metal oxides while minimizing the amount of noble metal that must be employed.

STATEMENT OF THE INVENTION

In accordance with the present invention there is provided an improved electrode which comprises an electrically conductive substrate having adhered thereto, and extending over at least a portion of the surface thereof, a coating of mixed oxides comprising about 10 to about 80 mole percent of indium oxide and about 10 to about 90 mole percent of a platinum group metal oxide. Tin oxide may also be incorporated in the mixed oxide coating in amounts, for example, of between about 0.1 to about 20 mole percent, and preferably about 0.1 to about 10 mole percent to lower the electrical resistivity of the coating. In compositions wherever the mole percent of indium oxide is greater than about 60 mole percent, it is preferred to include about 0.1 to 10 mole percent of tin oxide. Electrodes of this type, when employed as anodes in electrolytic cells, exhibit a considerable degree of durability in addition to the relatively low overvoltage characteristics of a noble metal oxide, making them well suited for use as anodes in the electrolytic production of chlorine from brine. In addition the electrodes of this invention are useful as anodes in the electrolytic production of chlorates, such as sodium chlorates as well as for electrodes for various other electrochemical applications such as electrowinning processes, electro-organic syntheses, fuel cells, and cathodic protection methods. Furthermore, as compared with the known commercial anodes employing an outer coating of a platinum group metal oxide, the cost of the present anodes is substantially less as a result of the reduction in the amount of platinum group metal oxide necessary.

DESCRIPTION OF THE PREFERRED EMBODIMENTS

The electrically conductive substrate which forms the inner or base component of the electrode is an electroconductive metal having sufficient mechanical strength to serve as a support for the coating and preferably having a high degree of chemical resistivity, especially to the anodic environment of electrolytic cells. The preferred materials for this purpose include the valve metals, for example, titanium, tantalum, niobium, zirconium and alloys thereof. The valve metals are well known for their tendency to form an inert oxide film upon exposure to an anodic environment. The preferred valve metal based on cost and availability, as well as electrical and chemical properties, is titanium. The conductivity of the substrate may be improved, if desired, by providing a central core of a highly conductive metal such as copper. In such an arrangement the core must be electrically connected to, and completely protected by, the valve metal substrate.

The oxide coating comprises oxides of indium and a platinum group metal. The platinum group metal oxides which may be employed include the oxides of platinum, iridium, rhodium, palladium, ruthenium and osmium. Based on compatability with indium oxide in the final mixed oxide coating, the preferred platinum group metal oxide is rhodium oxide. The oxide coating may comprise about 10 to about 80, and preferably about 25 to about 75 mole percent of indium oxide and about 10 to about 90 and preferably about 25 to about 75 mole percent of platinum group metal oxide. Up to about 20 mole percent of tin oxide may be advantageously incorporated in the coating to lower the electrical resistivity thereof. Especially preferred are those coating compositions comprising about 40 to about 60 mole percent of indium oxide and about 40 to about 60 mole percent of rhodium oxide.

The mixed oxide coatings may be adherently formed on the surface of the substrate by various methods. Prior to the application of the coatings the substrate may be first chemically cleaned, for example, by degreasing and etching the surface in a suitable acid, such as oxalic acid. The coating of mixed oxides may then be formed, for example, by forming the oxides in bulk, mixing in the appropriate proportions, then crushing to a powdered form, slurrying in a suitable liquid carrier or binder, applying to the substrate by spraying, brushing, rolling, dipping or other suitable method, and heating to decompose or volatilize the liquid and sinter the resultant oxide coating. Suitable volatile carriers for such purposes include, for example, aqueous or organic solvents such as toluene, benzene, ethanol, and the like. A preferred method of applying the coating of mixed oxides comprises applying to the surface of the substrate a solution of appropriate thermally decomposable salts, drying and heating in an oxidizing atmosphere. The salts that may be employed include, in general, any thermally decomposable inorganic or organic salt or ester of the elements whose oxides are desired in the final composition. Typical salts or esters include, for example, chlorides, nitrates, resinates, amines and the like.

The solution of thermally decomposable salts containing for example, a salt of indium and a salt of a noble metal are mixed in the desired proportions and then may be applied to the clean surface of the substrate by painting, brushing, dipping, rolling, spraying, or other method. The coating is then dried by heating, for example, at about 100° to 200° Celsius for several minutes to evaporate the solvent and then heating at a higher temperature, such as 250° to 800° Celsius in an oxidizing atmosphere to convert the compounds to the oxides form. The procedure may be repeated as many times as necessary to achieve a desired coating weight or thickness. The final coating weight of the mixed oxide coating may vary considerably, but is preferably in the range of about 5 to 50 grams per square meter.

The crystal structure of the oxide coating may vary and may be in the form e a solid solution, or mixture of oxides or both. For convenience in describing and calculating, it is postulated that the oxide coatings are mixed oxides, that is, a binary mixture of $In_2O_3$ and a platinum group metal oxide, such as $Rh_2O_3$. Where tin oxide is contained as a component it is characterized or calculated as $SnO_2$. It will thus be understood that the mole percents are based on the cation or metal ion and the specific oxide form may vary.

The following specific examples serve to further illustrate this invention. The examples describe the preparation of the electrodes and the performance of the electrodes as anodes in the electrolysis of brine. In each example, the titanium plate which serves as the substrate in the electrode was cleaned by immersion in hot oxalic acid, then washed and dried prior to the application of the surface coating. Overvoltage was determined with respect to a reversible chlorine-chloride reference electrode comprising a platinum mesh, in the same solution. In the examples and elsewhere in the specification and claims, all temperatures are in degrees Celsius and all parts are by weight, unless otherwise indicated.

EXAMPLE 1

A titanium plate was prepared by immersion in hot oxalic acid to etch the surface, then washed and dried. A solution of 21.16 parts of rhodium trichloride and 22.37 parts of indium trichloride in 200 parts of water was prepared and brushed onto the surface of the titanium substrate. The coated substrate was dried and fired in air at 500°C for five minutes. The procedure was repeated four times to increase the thickness of the coating.

The calculated composition of the mixed oxide coating thus prepared was 50 mole percent $Rh_2O_3$ and 50 mole percent $In_2O_3$. The coating weight of the finished coating was 6.64 grams per square meter.

The electrode, thus prepared, was tested as an anode in sodium chloride brine containing a 5 molar aqueous sodium chloride solution in an electrolysis cell with stainless steel cathode. At an operating temperature of 95°C and a current density of 300 milliamperes per square centimeter, the anode exhibited a chlorine overvoltage of about 135 millivolts. The anode was further tested at a constant current density of about 200 milliamperes per square centimeter. The anode performed satisfactorily, the chlorine overpotential remaining essentially constant (about 115 millivolts) for a period of about 144 hours, before testing was stopped.

EXAMPLE 2

A solution of 18.94 parts $RhCl_3$, 19.90 parts $InCl_3$, and 4.57 parts $SnCl_2.H_2O$ in 200 parts of water was prepared and brushed onto a titanium substrate. The coating was dried and fired at 500°C in air for 5 minutes. The procedure was repeated four times to increase the coating thickness.

The coating, thus prepared, had a calculated composition of 45 mole percent $Rh_2O_3$, 44.9 mole percent $In_2O_3$, and 10.1 mole percent $SnO_2$ and a coating weight of 6.86 grams per square meter.

The electrode, thus prepared, was installed and tested as an anode in an electrolytic cell containing sodium chloride brine having a strength of 5 molar sodium chloride. The cell was maintained at a temperature of 95°C. At a current density of 300 milliamperes per square centimeter the anode exhibited a chlorine overvoltage of about 82 millivolts. In further testing under the same cell conditions, except that a constant current density of 200 milliamperes per square centimeter was maintained, the chlorine overpotential remained essentially constant at about 77 millivolts for about 144 hours before testing was stopped.

EXAMPLE 3

A solution of 16.98 parts of $RhCl_3$, 1.82 parts of $InCl_3$ and 0.19 parts of $SnCl_2.2H_2O$ in 200 parts of water was prepared and brushed onto the surface of a cleaned titanium plate. The coated plate was then dried and fired in air at about 475°C for a period of about 10 minutes. The procedure was repeated six times to increase coating thickness. Following the final coating application the anode was fired in air at 400°C for a period of about 16 hours. The final coating weight was 30 grams per square meter.

The calculated composition of the mixed oxide coating thus prepared was 90 mole percent $Rh_2O_3$, 9.1 mole percent $In_2O_3$ and 0.9 mole percent $SnO_2$.

The electrode, thus prepared was tested as an anode in an electrolytic cell containing sodium chloride brine having a strength of 5 molar sodium chloride, and maintained at 95°C. At a current density of about 150 milliamperes per square centimeter the anode exhibited a chlorine overpotential of about 80 millivolts. At a current density of about 300 milliamperes per square centimeter the anode exhibited a chlorine overpotential of about 95 millivolts.

EXAMPLE 4

An electrode was prepared and tested as in Example 3, except that the proportions of the coating solution were adjusted to 5.96 parts of $RhCl_3$, 17.0 parts of $InCl_3$, 1.96 parts of $SnCl_2.2H_2O$ in 200 parts of water to yield a final coating composition of 25 mole percent $Rh_2O_3$, 67.4 mole percent $In_2O_3$ and 7.6 mole percent $SnO_2$. At a constant current density of about 150 milliamperes per square centimeter, the anode exhibited a chlorine overvoltage of about 130 millivolts. When current density was increased to about 30 milliamperes per square centimeter the anode exhibited a chlorine overpotential of about 185 millivolts.

EXAMPLE 5

A slurry of about 10 parts of $In_2O_3$ in a solution of 15 parts of $Rh(NO_3)_3$ in 200 parts of water was brushed onto the surface of a cleaned titanium plate and the coating was dried and fired in air at about 400°C for 10 minutes. The procedure was repeated 6 times to yield a coating having a calculated composition of 50 mole percent $Rh_2O_3$ and 50 mole percent $In_2O_3$ and to provide a final coating weight of about 50 grams per square meter.

When installed as anode and tested as in the preceding examples at a current density of about 300 milliamperes per square centimeter the anode exhibited a chlorine overpotential of about 80 millivolts. The current density was adjusted to about 150 milliamperes per square centimeter and maintained thereat for a period of about 72 hours. Under the latter conditions the chlorine overpotential remained essentially constant at about 63 millivolts.

EXAMPLE 6

An aqueous solution of 14.56 parts of $Rh(NO_3)_3$ and 11.06 parts of $InCl_3$ in 1.31 parts of water was brushed onto the cleaned surface of a titanium plate. The coating was dried and fired in air at about 400°C for about 10 minutes. The procedure was repeated six times to provide a final coating weight of 48 grams per square meter and a calculated composition of about 50 mole percent $Rh_2O_3$ and about 50 mole percent $In_2O_3$. When installed and tested as an anode in an electrolytic cell in the manner described in the preceding examples, the anode exhibited a chlorine overpotential of about 66 millivolts at a current density of about 150 milliamperes per square centimeter, and a chlorine overpotential of about 80 millivolts at a current density of about 300 milliamperes per square centimeter. Under further testing under the same cell conditions and at a constant current density of about 150 milliamperes per square centimeter, the chlorine overpotential remained essentially constant at about 80 millivolts for about 72 hours, at which time the test was stopped.

It will be seen that anodes produced according to the present invention, as shown in the foregoing examples, may be employed in the electrolysis of brines with a desirably low overvoltage, comparable to dimensionally stable anodes having an operative electrode service of relatively pure platinum group metal oxide.

The foregoing specification is intended to illustrate the invention with certain preferred embodiments, but it is understood that the details disclosed herein can be modified without departing from the spirit and scope of the invention.

We claim:

1. An electrode which comprises an electrically conductive substrate having adhered thereto and extending over at least a portion of the surface thereof, a coating of mixed oxides comprising about 10 to about 80 mole percent indium oxide, and about 10 to about 90 mole percent of a platinum group metal oxide.

2. An electrode according to claim 1 wherein the electrically conductive substrate is a valve metal.

3. An electrode according to claim 2 wherein the electrically conductive substrate is titanium.

4. An electrode according to claim 3 wherein the platinum group metal oxide is rhodium oxide.

5. An electrode according to claim 1 wherein the coating of mixed oxides includes from about 0.1 to about 20 mole percent of tin oxide.

6. An electrode according to claim 5 wherein the coating of mixed oxides consists essentially of about 60 to about 75 mole percent indium oxide, about 25 to about 40 mole percent rhodium oxide and about 0.1 to about 10 mole percent tin oxide.

7. An electrode according to claim 6 wherein the electrically conductive substrate is titanium.

8. An electrode according to claim 1 wherein the coating of mixed oxides comprises from about 25 to about 75 mole percent of indium oxide and from about 25 to about 75 mole percent of a platinum group metal oxide.

9. An electrode according to claim 8 wherein the platinum group metal oxide is rhodium oxide.

10. An electrode according to claim 9 wherein the electrically conductive substrate is titanium.

11. An electrode according to claim 10 wherein the coating of mixed oxides consists essentially of about 40 to about 60 mole percent indium oxide and about 40 to about 60 mole percent of rhodium oxide.

* * * * *